US006745418B1

(12) United States Patent
Turner, Jr.

(10) Patent No.: US 6,745,418 B1
(45) Date of Patent: Jun. 8, 2004

(54) PILLOW

(76) Inventor: David H. Turner, Jr., 10176 Jesmond Dr., Escondido, CA (US) 92026-8617

( * ) Notice: Subject to any disclaimer, the term of this patent is extended or adjusted under 35 U.S.C. 154(b) by 0 days.

(21) Appl. No.: 10/236,172

(22) Filed: Sep. 6, 2002

(51) Int. Cl.[7] ..... A47G 9/00
(52) U.S. Cl. ..... 5/638; 5/644; D6/601
(58) Field of Search ..... 5/638, 644, 636, 5/655.3; D6/601

(56) References Cited

U.S. PATENT DOCUMENTS

| | | | | | |
|---|---|---|---|---|---|
| 3,568,227 | A | * | 3/1971 | Dunham | 5/644 |
| 4,606,086 | A | * | 8/1986 | Rowland | 5/111 |
| 4,688,285 | A | * | 8/1987 | Roberts | |
| D298,992 | S | * | 12/1988 | Voss | 5/638 |
| D381,524 | S | * | 7/1997 | Gabriel | D6/361 |
| D394,978 | S | * | 6/1998 | Smith | D6/601 |
| 6,128,797 | A | * | 10/2000 | Shaffer | 5/638 |
| 6,230,350 | B1 | * | 5/2001 | Goldstein | 5/636 |
| 6,427,272 | B1 | * | 8/2002 | Yacoub | 5/638 |

FOREIGN PATENT DOCUMENTS

| | | | | |
|---|---|---|---|---|
| AT | 88689 B | * | 6/1922 | 5/644 |
| DE | 2409201 A | * | 9/1975 | 5/644 |

* cited by examiner

*Primary Examiner*—Alexander Grosz

(57) ABSTRACT

A pillow for supporting the head of user when the user is laying on their stomach. The pillow includes a body member defining an annular bore whereby the body member is substantially toroidal shaped. The body member is designed for supporting the head of the user whereby the annular bore is for receiving a face of the user when the user is laying face down. The body member has a plurality of ventilating bores extending through the body member. Each of the ventilating bores extends into the annular bore whereby the ventilating bores are designed for permitting air to flow to the user when the face of the user is positioned in the annular bore.

6 Claims, 2 Drawing Sheets

PILLOW

BACKGROUND OF THE INVENTION

1. Field of the Invention

The present invention relates to therapeutic pillows and more particularly pertains to a new pillow for supporting the head of user when the user is laying on their stomach.

2. Description of the Prior Art

The use of therapeutic pillows is known in the prior art. U.S. Pat. No. 4,898,164 describes a device for supplying air to the area of a subjects nose and mouth when the user is lying face down on the pillow. Another type of therapeutic pillow is U.S. Pat. No. 5,535,468 having a pillow for preventing the suffocation of an infant laying in a face down position. Another type of therapeutic pillow is demonstrated in U.S. Pat. No. 2,688,142 and U.S. Pat. No. 4,752,064 each has a head rest that is for permitting a user to breathe while laying in a face down position. Another type of therapeutic pillow is U.S. Pat. No. Des. 375,557 having a therapeutic pillow for receiving the head of a user. Another type of therapeutic pillow is U.S. Pat. No. 5,630,651 having a cervical pillow for supporting the head an neck of the user. Another type of therapeutic pillow is U.S. Pat. No. 3,366,106 having a therapeutic pillow for facilitating neck recuperation.

While these devices fulfill their respective, particular objectives and requirements, the need remains for a device that has certain improved features that permit the user to breathe freely while in a face down position and for providing adequate support of the head.

SUMMARY OF THE INVENTION

The present invention meets the needs presented above by providing a body member defining an annular bore for receiving the face of the user. The body member has a plurality of ventilating bores that permit air to flow to the face of the user for unimpeded breating.

Still yet another object of the present invention is to provide a new pillow that supports the head of the user when the user is sleeping face down without pressing directly on the face of the user.

Even still another object of the present invention is to provide a new pillow that allows unimpeded air flow to the face of the user when the face of the user is positioned in the annular bore if the body member.

To this end, the present invention generally comprises a body member defining an annular bore whereby the body member is substantially toroidal shaped. The body member is designed for supporting the head of the user whereby the annular bore is for receiving a face of the user when the user is laying face down. The body member has a plurality of ventilating bores extending through the body member. Each of the ventilating bores extends into the annular bore whereby the ventilating bores are designed for permitting air to flow to the user when the face of the user is positioned in the annular bore.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
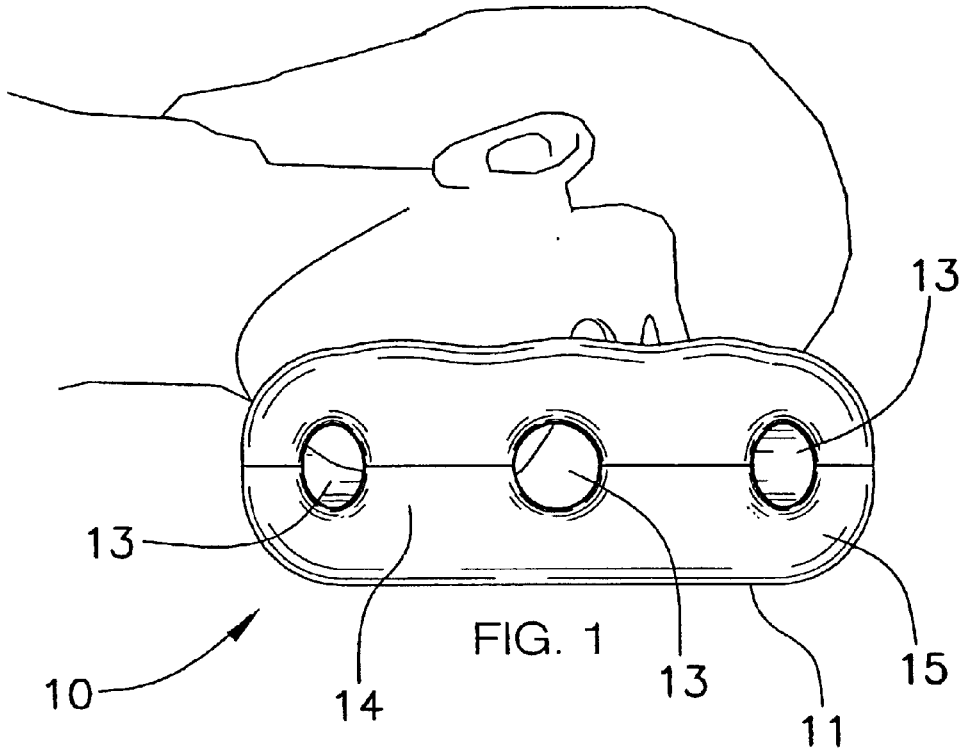
FIG. 1 is a side view of a new pillow according to the present invention in use.
Figure 2:
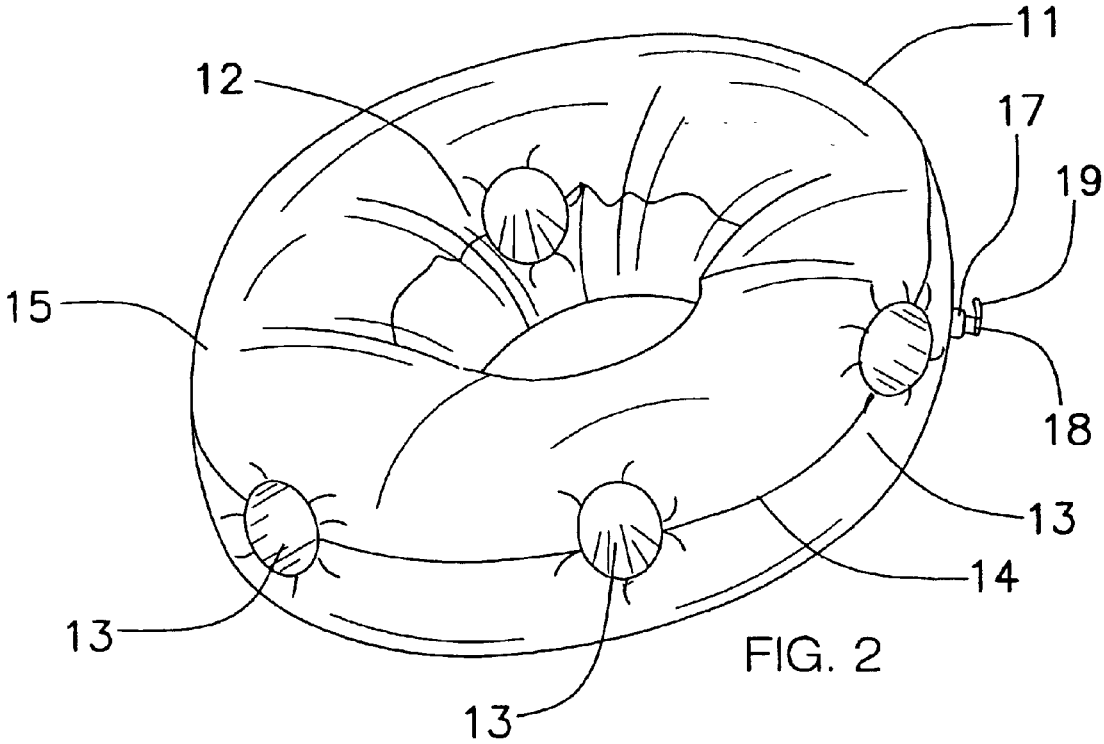
FIG. 2 is a perspective view of the present invention.

With reference now to the drawings, and in particular to FIGS. 1 through 4 thereof, a new pillow embodying the principles and concepts of the present invention and generally designated by the reference numeral 10 will be described.

Figure 3:
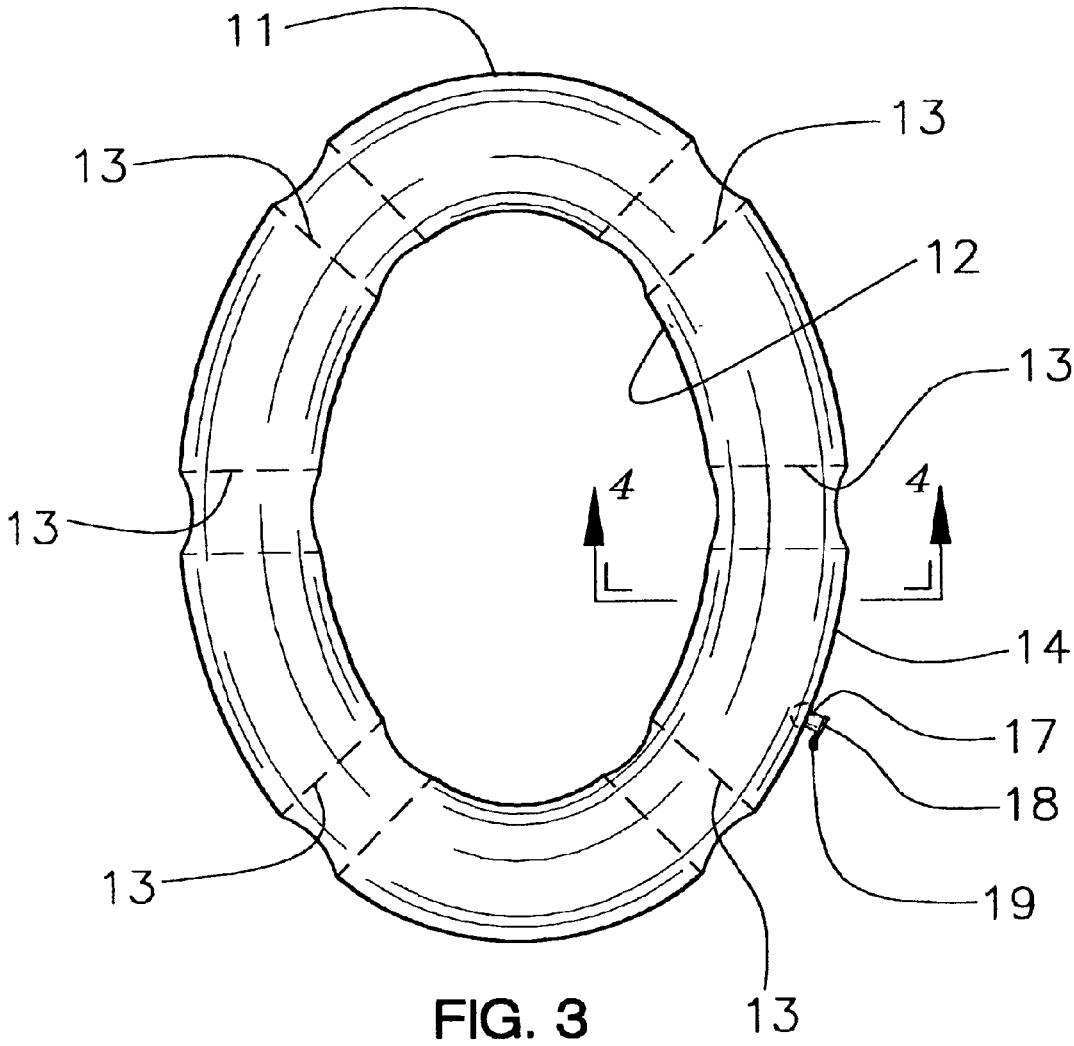
FIG. 3 is a top view of the present invention.
Figure 4:
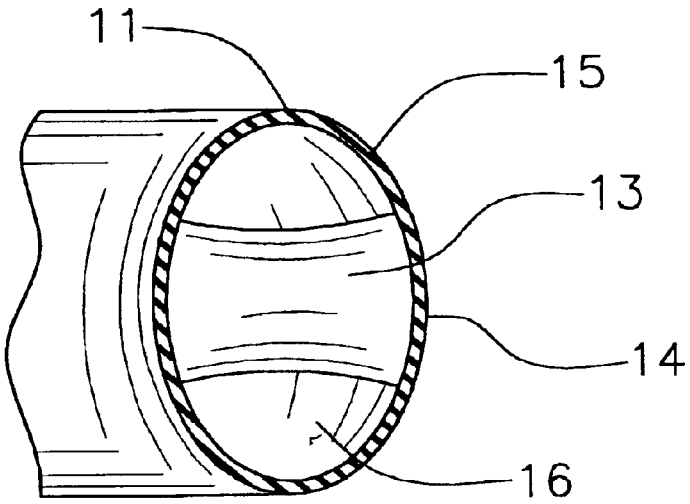
FIG. 4 is a cross-sectional view of the present invention taken along line 4—4 of FIG. 3.

As best illustrated in FIGS. 1 through 4, the pillow 10 generally comprises a body member 11 defining an annular bore 12 whereby the body member 11 is substantially toroidal shaped. As shown in FIG. 3, the body member 11 may have a generally elliptical shape. The body member 11 is designed for supporting the head of the user whereby the annular bore 12 is for receiving a face of the user when the user is laying face down. The body member 11 has an over length between 6 to 8 inches, a width between 5 to 6 inches and a depth of about 3 inches.

The body member 11 has a plurality of ventilating bores 13 extending through the body member 11. Each of the ventilating bores 13 extends into the annular bore 12 whereby the ventilating bores 13 are designed for permitting air to flow to the user when the face of the user is positioned in the annular bore 12. Each of the ventilating bores 13 extends from a side portion 14 of the body member 11 into the annular bore 12 for preventing the ventilating bores 13 from becoming inadvertently blocked and restricting the flow of air to the user when the face of the user is positioned in the annular bore 12.

The body member 11 has a perimeter wall 15. The perimeter wall 15 defines an interior space 16. The interior space 16 is designed for holding air whereby the air in the interior space 16 is for maintaining a shape of the body member 11 when the head of the user is resting on the body member 11.

A valve member 17 is coupled to the perimeter wall 15 of the body member 11. The valve member 17 is in fluid communication with the interior space 16 of the body member 11. The valve member 17 is designed for permitting the user to inflate the body member 11 by adding air to the interior space 16. The valve member 17 is designed for permitting the user to deflate the body member 11 by expelling air for the interior space 16 through the valve member 17 for better storage of the body member 11.

A cap member 18 is selectively couplable to the valve member 17. The cap member 18 is designed for preventing fluid communication between the interior space 16 of the body member 11 and the environment when the cap member 18 is coupled to the valve member 17. A tether member 19 is coupled to the valve member 17 and the cap member 18.

The tether member 19 is for securing the cap member 18 to the valve member 17 whereby the cap member 18 is prevented from being lost when the cap member 18 is removed from the valve member 17.

In use, the user removes the cap member 18 from the valve member 17 and blows air into the interior space 16 of the body member 11. The cap member 18 is then replaced to inhibit the air in the interior space 16 of the body member 11 from being expelled and deflating the body member 11. The user then lays on their stomach and positions their face in the annular bore 12 defined by the body member 11. The ventilating bores 13 allow air to flow freely between the environment and the annular bore 12 for permitting free breathing of the user. When the body member 11 is no longer in use the user removes the cap member 18 from the valve member 17 to deflate the body member 11 for more compact storage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pillow for supporting the head of a user, the pillow comprising:

a body member defining an annular bore, said body member being adapted for supporting the head of the user such that said annular bore is for receiving a face of the user when the user is laying face down;

said body member having a plurality of ventilating bores extending through said body member, each of said ventilating bores extending into said annular bore such that said ventilating bores are adapted for permitting air to flow to the user when the face of the user is positioned in the annular bore;

said body member comprising a substantially elliptical shape such that a length of said body member is greater than a width of said body member, said elliptical shape of said body member being adapted for substantially matching a shape of the head of the user to allow greater contact between the body member and the head of the user to reduce the formation of localized pressure points on the head of the user; and said body member having a perimeter wall, said perimeter wall defining an interior space, said interior space being adapted for holding air such that the air in said interior space is for maintaining a shape of said body member when the head of the user is resting on said body member, said perimeter wall of said body member comprising a substantially elliptical cross-section taken along an axis of said body member such that a height of said interior space is greater than a width of said interior space defined by said perimeter wall, said elliptical cross-section of said perimeter wall being adapted for providing a larger area of contact to the face of the user to spread the force applied to the face of the user over a greater area to increase comfort when the face of the user is positioned in said annular bore.

2. The pillow as set forth in claim 1, wherein each of said ventilating bores extends from a side portion of said body member into said annular bore for preventing said ventilating bores from becoming inadvertently blocked and restricting the flow of air to the user when the face of the user is positioned in the annular bore.

3. The pillow as set forth in claim 1, further comprising:

a valve member being coupled to said perimeter wall of said body member, said valve member being in fluid communication with said interior space of said body member, said valve member being adapted for permitting the user to inflate said body member by adding air to said interior space, said valve member being adapted for permitting the user to deflate said body member by expelling air from said interior space through said valve member for better storage of said body member.

4. The pillow as set forth in claim 3, further comprising:

a cap member being selectively couplable to said valve member, said cap member being adapted for preventing fluid communication between said interior space of said body member and the environment when said cap member is coupled to said valve member.

5. The pillow as set forth in claim 4, further comprising:

a tether member being coupled to said valve member and said cap member, said tether member being for securing said cap member to said valve member such that said cap member is prevented from being lost when said cap member is removed from said valve member.

6. A pillow for supporting the head of a user, the pillow comprising:

a body member defining an annular bore, said body member being adapted for supporting the head of the user such that said annular bore is for receiving a face of the user when the user is laying face down;

said body member having a plurality of ventilating bores extending through said body member, each of said ventilating bores extending into said annular bore such that said ventilating bores are adapted for permitting air to flow to the user when the face of the user is positioned in the annular bore;

said body member comprising a substantially elliptical shape such that a length of said body member is greater than a width of said body member, said elliptical shape of said body member being adapted for substantially matching a shape of the head of the user to allow greater contact between the body member and the head of the user to reduce the formation of localized pressure points on the head of the user;

each of said ventilating bores extending from a side portion of said body member into said annular bore for preventing said ventilating bores from becoming inadvertently blocked and restricting the flow of air to the user when the face of the user is positioned in the annular bore;

said body member having a perimeter wall, said perimeter wall defining an interior space, said interior space being adapted for holding air such that the air in said interior space is for maintaining a shape of said body member when the head of the user is resting on said body member, said perimeter wall of said body member comprising a substantially elliptical cross-section taken along an axis of said body member such that a height of said interior space is greater than a width of said interior space defined by said perimeter wall, said elliptical cross-section of said perimeter wall being adapted for providing a larger area of contact to the face of the user to spread the force applied to the face of the user over a greater area to increase comfort when the face of the user is positioned in said annular bore;

a valve member being coupled to said perimeter wall of said body member, said valve member being in fluid communication with said interior space of said body member, said valve member being adapted for permitting the user to inflate said body member by adding air to said interior space, said valve member being adapted for permitting the user to deflate said body member by expelling air for said interior space through said valve member for better storage of said body member;

a cap member being selectively couplable to said valve member, said cap member being adapted for preventing fluid communication between said interior space of said body member and the environment when said cap member is coupled to said valve member; and a tether member being coupled to said valve member and said cap member, said tether member being for securing said cap member to said valve member such that said cap member is prevented from being lost when said cap member is removed from said valve member.

* * * * *